US007891467B2

(12) United States Patent
Kattainen et al.

(10) Patent No.: US 7,891,467 B2
(45) Date of Patent: Feb. 22, 2011

(54) ELEVATOR SAFETY ARRANGEMENT HAVING SAFETY SPACES

(75) Inventors: Ari Kattainen, Hyvinkää (FI); Kimmo Heikkilä, Hyvinkää (FI); Timo Syrman, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 12/496,683

(22) Filed: Jul. 2, 2009

(65) Prior Publication Data

US 2009/0321192 A1 Dec. 31, 2009

Related U.S. Application Data

(63) Continuation of application No. PCT/FI2007/000302, filed on Dec. 21, 2007.

(30) Foreign Application Priority Data

Jan. 3, 2007 (FI) ..... 20070006

(51) Int. Cl.
*B66B 1/34* (2006.01)

(52) U.S. Cl. ..... 187/394; 187/316

(58) Field of Classification Search ..... 187/300, 187/313, 316, 279, 280, 391–396; 340/545.1, 340/545.3, 545.6, 545.9, 565, 567
See application file for complete search history.

(56) References Cited

U.S. PATENT DOCUMENTS 5,476,157 A * 12/1995 Todaro ..... 187/280
6,032,761 A * 3/2000 Coste et al. ..... 187/294
6,173,814 B1 1/2001 Herkel et al.
6,193,019 B1 * 2/2001 Sirigu et al. ..... 187/391
6,223,861 B1 5/2001 Sansevero
6,452,477 B1 * 9/2002 Roca et al. ..... 338/61
6,550,585 B2 * 4/2003 Schoppa et al. ..... 187/391
6,603,398 B2 * 8/2003 Tinone et al. ..... 340/541
7,201,256 B2 * 4/2007 Deplazes et al. ..... 187/300
7,278,517 B2 * 10/2007 Gut ..... 187/300
7,350,626 B2 * 4/2008 Lence et al. ..... 187/393
7,533,763 B2 * 5/2009 Kattainen et al. ..... 187/394
2009/0288920 A1 * 11/2009 Kattainen et al. ..... 187/287

FOREIGN PATENT DOCUMENTS

WO WO-2006/108433 A1 10/2006

* cited by examiner

*Primary Examiner*—Jonathan Salata
(74) *Attorney, Agent, or Firm*—Birch, Stewart, Kolasch & Birch, LLP

(57) ABSTRACT

An elevator safety arrangement and a method for implementing safety spaces in an elevator has a mechanical safety device which can be set to a working position to ensure a sufficient safety space in the elevator shaft and an electric safety system for identifying the operating state of the mechanical safety device. According to the method of the invention, detectors in the electric safety system are read by an electric safety controller and, when a functional deviation is detected, one or more stopping devices are actuated to bring the elevator system into a safe operating state.

15 Claims, 3 Drawing Sheets

ELEVATOR SAFETY ARRANGEMENT HAVING SAFETY SPACES

This application is a Continuation of PCT/FI2007/000302 filed on Dec. 21, 2007, and claims priority under 35 U.S.C. §119(a) on Patent Application No. 20070006 filed in Finland on Jan. 3, 2007, respectively, all of which are hereby expressly incorporated by reference into the present application.

FIELD OF THE INVENTION

The present invention relates to an elevator safety.

PRIOR ART

When elevators in old buildings are to be modernized, problems are often encountered because the safety regulations have been changed in the course of years and the spaces above and below the elevator car in the elevator shaft are not large enough to satisfy the new safety regulations. Extending the shaft upwards or downwards is in most cases impossible in respect of construction technology or at least too expensive and difficult to be considered as an alternative.

New buildings are constructed with a view to saving space in the elevator shaft. This is accomplished by designing the spaces above and below the car in the elevator shaft to as small dimensions as possible. In this case, there is no sufficient safety space left in the elevator shaft above and below the elevator car to provide personal protection for a serviceman working on the top of the elevator car or in the elevator shaft.

In the case of old buildings, the safety regulations permit limitation of the shaft spaces above and below the car, provided that the elevator shaft is provided with mechanical safety devices that can be set up in connection with work carried out in the elevator shaft so as to ensure a sufficient safety space in the upper and lower parts of the elevator shaft. These safety devices limit the extreme ends of the path of movement of the elevator car in the elevator shaft in a manner such that a sufficient working space is left for an installer. In the future, a similar safety solution officially approved by the authorities is likely to be used in new buildings as well.

A safety device often used is a turnable buffer placed on the shaft bottom so that a serviceman can turn it to an upright working position before starting work in the elevator shaft. The turnable buffer may be placed on the bottom of the elevator shaft below the elevator car, in which case it will limit the movement of the elevator car in the shaft bottom space, or it may be placed below the counterweight, in which case it will limit the movement of the counterweight in the shaft bottom space while at the same time limiting the movement of the elevator car in the headroom space in the shaft. In this case, to determine the required safety distance in the headroom space in the elevator shaft, it is necessary to take into account that, when the counterweight hits the buffer at the shaft bottom, the elevator car, due to its kinetic energy, still goes on moving upwards in the top end of the shaft. The length of this movement depends on the highest possible speed that the elevator car may have at the instant of the counterweight colliding with the buffer. Thus, the safety distance must be so designed that it corresponds to the highest possible speed at the instant of collision. In addition, in determining the safety distance both in the headroom space and in the bottom space of the elevator shaft, the buffer compression caused by the collision has to be taken into account.

The previously known state of the art is represented by specification WO 97/23399. This specification discloses an arrangement providing a safety space at the lower end of an elevator shaft. It comprises a support pillar which is arranged in the path of the car frame and which is turned to a working position by means of an actuating element secured to the floor of the shaft and to the support pillar. Arranged in conjunction with the support pillar are the required switches to indicate the position of the support pillar.

According to regulations, the operation of a mechanical safety device also has to be supervised. It is required that the system be able to detect a maintenance man entering the elevator shaft, and likewise to detect the operating state of the mechanical safety device.

Specification JP03018575 discloses a switch which is mounted in conjunction with a mechanical safety device and whose position changes when the mechanical safety device is turned into a working position. Operation of the elevator motor is not allowed until a change of state of the switch indicates that the mechanical safety device has been turned into the working position. The solution for an electric safety arrangement described in this specification is based on discrete components, such as relays and switches, and is therefore very complicated in respect of the required wiring. Moreover, the testing of operation, which is important in regard of safety of operation of the switch, requires a separate control logic and thus further increases the complexity of the solution. As the electric safety arrangement is implemented using discrete components, such as relays and switches, the system is sensitive to momentary breaks in the control of the switches and to contact problems, which occur in an elevator system from time to time. If the operation of the elevator system is interrupted due to momentary breaks like this, then the reliability of operation of the elevator system also deteriorates. For a safety arrangement consistent with regulations, it is additionally required that a person entering the elevator shaft be detected and taken into account in the design of the logic of operation of the safety arrangement.

Specification EP1159218B discloses an elevator safety device comprising an electric safety controller that reads data from sensors connected to the elevator system and, when it detects a safety risk in the elevator system, sends a control signal to the elevator motor controller, to the elevator brake and to the control center of the elevator system. However, the safety controller according to this specification can not in itself provide a level of safety sufficient for the operation of the safety arrangement according to the present invention. For an implementation of the safety arrangement compliant to regulations, it is required that the elevator shaft be provided with detectors serving to define the allowed extreme limits of elevator car travel in the elevator shaft during maintenance operation, and additionally detectors defining the allowed limits of elevator car travel during normal operation. Furthermore, detectors are needed to identify a 'person in shaft' state, such as e.g. when an installer enters the elevator shaft. In addition, a control logic is needed for monitoring the safety of the elevator system on the basis of detector data in different operational modes of the elevator system.

OBJECT OF THE INVENTION

The object of the present invention is to disclose a new type of safety arrangement for implementing the safety spaces in an elevator shaft as required by regulations. A further object of the invention is to disclose a new type of electric safety system that monitors the entry of a person into the elevator shaft as well as the state of mechanical safety devices.

FEATURES OF THE INVENTION

Inventive embodiments are presented in the description part of the present application. The inventive content disclosed in the application can also be defined in other ways. The inventive content may also consist of several separate inventions, especially if the invention is considered in the light of explicit or implicit sub-tasks or with respect to advantages or sets of advantages achieved.

The present invention concerns an elevator safety arrangement and a method according to the safety arrangement.

An elevator safety arrangement for implementing the prescribed safety spaces in an elevator shaft comprises a mechanical safety device, preferably a pole or barrier, which can be moved into a service position to ensure a sufficient safety space in the elevator shaft. Moreover, the safety arrangement comprises an electric safety system, which comprises in conjunction with the mechanical safety device at least one detector for identifying the operating state of the mechanical safety device, in conjunction with an elevator landing door at least one detector for identifying the position of the landing door, means for reading the detectors fitted in conjunction with the elevator landing door, in conjunction with the elevator car door at least one detector for identifying the position of the elevator car door, means for reading the detectors in conjunction with the elevator car door, and an electric safety controller which reads data from the elevator control devices and from the detectors comprised in the electric safety controller and, based on the data thus collected, controls one or more mechanical stopping devices which stop the movement of the elevator car in the elevator shaft. In addition, the electric safety system comprises a data interface bus between the electric safety controller and the elevator control devices. In this bus, data is transferred both for determining the safety of the elevator and for controlling the elevator in a normal operating situation.

The electric safety controller reads information about the position of the elevator landing door and the position of the elevator car door and, based on this information, infers whether a person has entered the elevator shaft, i.e. deduces a 'person in shaft' state. After a 'person in shaft' state has been detected, the electric safety controller only allows maintenance operation after it detects that the mechanical safety device has assumed its operating position. For example, it is possible for a maintenance man to enter the elevator shaft by opening a landing door manually by means of a key used for that purpose.

In a preferred embodiment of the invention, the safety arrangement additionally comprises in conjunction with an elevator maintenance operation unit at least one detector for identifying the state of control of the elevator maintenance operation unit and, in the vicinity of each end of the elevator shaft, at least one end limit marker, and in conjunction with the elevator car at least one end limit marker reader for determining the extreme limits of movement of the elevator car in the elevator shaft.

The above-mentioned elevator control devices include e.g. an elevator system controller, an elevator motor controller and an elevator car door controller.

In an embodiment of the invention, two separate sets of end limit markers are placed in the elevator shaft near each end for determining the position of the elevator car, of which end limit markers the ones located closer to the ends of the elevator shaft determine the extreme limits of elevator car movement during normal operation while the ones located farther away from the ends determine the extreme limits of elevator car movement during maintenance operation. Fitted in conjunction with the elevator car are readers for reading the end limit markers, said readers being connected to the electric safety controller via the data interface bus.

In a preferred embodiment of the invention, the arrangement comprises two end limit marker readers fitted in conjunction with the elevator car and two end limit markers fitted at either end of the elevator shaft. The readers used in this embodiment for reading the end limit markers are switches, and the end limit markers used are ramps, which are fitted in the elevator shaft in such a way that a switch mounted in conjunction with the elevator car will come into contact with the ramp and is opened when the elevator car moves in the shaft until it reaches the ramp. The positions of the ramps in the shaft and the positions of the switches in conjunction with the elevator car have been so chosen that they interlap each other in such manner that one of the switches, which is referred to as K1, can be brought at the upper end of the elevator shaft into contact with the ramp placed farther away from the end and at the lower end of the elevator shaft with the ramp placed closer to the end. Correspondingly, switch K2 can be brought into contact with the ramp placed closer to the end at the upper end of the elevator shaft and with the ramp placed farther away from the end at the lower end of the elevator shaft. Using the electric safety controller, the state of the switches is read and, based on the state, the position of the elevator car in the elevator shaft is inferred. If it is detected that both switch K1 and switch K2 are open, then both normal and maintenance operation of the elevator is prevented. If it is detected that only switch K1 is open, then only maintenance operation in the upward direction is inhibited. If it is detected that only switch K2 is open, then only maintenance operation in the downward direction is inhibited. This solution provides the advantage that all four end limit markers can be read by means of two simple end limit marker readers, such as switches. This reduces the amount of wiring between the readers and the electric safety controller.

The detectors fitted in conjunction with the elevator landing doors may preferably be switches whose contact is opened by forced control as the landing doors are opened. The switches are arranged in series as a series circuit, which is connected to the electric safety controller via a gateway to allow measurement of the state of the series circuit.

In an embodiment of the invention, the means for reading the detectors fitted in conjunction with the elevator landing door comprise, fitted in parallel with each switch in the series circuit, a resistor of equal resistance value. In another embodiment of the invention, the means for reading the detectors fitted in conjunction with the elevator landing door comprise a resistor of unequal resistance value fitted in parallel with each switch in the series circuit. When resistors of unequal resistance value are used, it is possible to identify the position of each individual switch in the series circuit. The resistor according to the invention may preferably be an encapsulated film resistor. Such a film resistor may be e.g. a metal film resistor. The structure of the film resistor is such that the resistance element is well protected e.g. against impurities. This means that it is highly unlikely for the resistor to undergo a failure that would short-circuit the resistance element. This improves the reliability of a measuring circuit that uses film resistors. The electric safety controller may additionally comprise means for measuring the total resistance of the series circuit. Such means may consist of e.g. a voltage source provided in connection with the electric safety controller and used to supply a voltage into the series circuit, and a current measuring sensor for measuring the current flowing in the series circuit. From the ratio between the voltage supplied and the current measured, it is possible to infer the total resistance of the series circuit. Such a circuit provides the advantage that, if all the resistors in the series circuit are of equal resistance value, then the number of open switches in the series circuit can be established by measuring the total resistance. If the switches are placed in connection with doors, such as landing doors, then the number of doors open can be detected.

The state of the switches in the series circuit can also be determined, using the same apparatus and method, without resistors fitted in parallel with the switches. In this case, the opening of one of the switches leads to a break in the flow of current through the switches.

The electric safety controller according to the invention may be integrated in conjunction with another device used in the control of the elevator system. The safety arrangement of the invention can also be used in elevator systems without machine room, in which case the space saving achieved by integrating the electric safety controller is an advantage. Furthermore, the safety arrangement of the invention can also be used in elevator systems without counterweight.

In an embodiment of the invention, information is transmitted to the electric safety controller over a data interface bus from a control device fitted in conjunction with the elevator car. The information transmitted contains at least data about the control of the elevator maintenance operation unit, data about the position of the elevator car in the elevator shaft, data about the state of the end limit switches of the elevator shaft separately during normal operation and maintenance operation, data about the position of the manhole cover in the top of the elevator car, and data about the state of the doors of the elevator car. From the electric safety controller, at least data regarding the operational state of the electric safety controller is transmitted via the data interface bus to the control device fitted in conjunction with the elevator car.

Via the interface bus, data is also transmitted between the electric safety controller and the elevator motor controller as well as data between the electric safety controller and the elevator system controller. The elevator motor controller sends to the electric safety controller at least a request for closing the main contactor and a request for releasing the brake. In addition, the elevator motor controller sends to the electric safety controller a request for advance opening of the doors as the elevator car is approaching the target floor. The elevator system controller also sends to the electric safety controller a request for closing the main contactor and releasing the brake. For the brake to be released and the main contactor to be closed, it is required that the electric safety controller receive congruent control requests from both the elevator motor controller and the elevator system controller.

The electric safety controller sends to the elevator system controller and to the elevator motor controller at least data regarding its operational state.

In a method according to the invention for implementing safety spaces in an elevator shaft, the number of landing doors open is read by means of detectors fitted in conjunction with the elevator landing doors, the number of elevator car doors open is read by means of detectors fitted in conjunction with the elevator car doors, and the position of the mechanical safety device is read by means of detectors fitted in conjunction with the mechanical safety device. These reading operations can be performed by an electric safety controller comprising means for measuring the total resistance of the series circuit. The number of doors open can be read from the total resistance of the series circuit. If according to the method it is detected that the number of landing doors open is greater than the number of elevator car doors open, then the safety system is set into the 'person in shaft' state and operation of the elevator is prevented. If it is detected that, when the safety system is in the 'person in shaft' state, the number of landing doors open is equal to the number of elevator car doors open, and that the mechanical safety device has been set into the service position, then maintenance operation is allowed. In an embodiment according to the invention, a manually controlled reset mechanism is arranged in conjunction with the electric safety controller to allow the elevator system to be restored to normal operation. In an embodiment of the invention, the aforesaid reset mechanism is disposed on the bottom-most floor in the elevator shaft. In another embodiment of the invention, the aforesaid reset mechanism is integrated with the operating interface for maintenance operation of the elevator system.

In a method according to the invention, after the safety system has been set into the 'person in shaft' state, data about this change is saved in the non-volatile memory of the electric safety controller. According to a preferred embodiment of the invention, the state of the manually controlled reset mechanism is also read by means of the electric safety controller, and when it is detected that the reset mechanism has been reset into the state of cancellation of inhibition of normal operation, the program being executed by the electric safety controller is reset from the 'person in shaft' state and data about this change is stored in the non-volatile memory of the electric safety controller. Data regarding the change into the 'person in shaft' state as well as cancellation of that state can also be sent via the data interface bus to the control devices.

In a method according to the invention, the data of the detectors in the electric safety system are read via the connection interface of the electric safety controller simultaneously by at least two microcontrollers and the data items read by the microcontrollers of the electric safety controller are compared to each other and the functional states of the microcontrollers are monitored via a communication bus between the microcontrollers. If it is discovered that the data read from the detectors differs between the microcontrollers or a failure situation is detected in the functional state of a microcontroller, then operation of the elevator is prevented by actuating by means of the electric safety controller at least one mechanical stopping device and in the same connection a command preventing operation is transmitted by the electric safety controller via the data interface bus to the controller of the elevator motor and data regarding the prevention of operation is transmitted to the control devices.

In an embodiment of the invention, the electric safety controller comprises an non-volatile memory for the storage of data during a power failure. The non-volatile memory is arranged to communicate with at least one processor of the electric safety controller via a communication bus reserved for that purpose.

In a method according to the invention, an electric safety controller containing a non-volatile memory is used. In this method, the operating voltage of the electric safety controller is read by the safety controller itself. If it is detected that the operating voltage of the electric safety controller has fallen below a certain limit value, then the program being executed by the electric safety controller is set into a state where data is written to the non-volatile memory of the electric safety controller. Those variables of the electric safety controller which describe the current status of the program executed by the electric safety controller at the instant of activation of the write process are written to the non-volatile memory of the electric safety controller.

In another method according to the invention, in which an electric safety controller containing a non-volatile memory is likewise used, those variables of the program being executed by the electric safety controller which describe the status prevailing at the instant of time in question in the program being executed by the electric safety controller are written to the non-volatile memory of the electric safety controller at regular intervals, e.g. at 10 ms intervals. In addition, in this method, in connection with each write situation an index variable for subsequent identification of the write situation is saved to the non-volatile memory of the electric safety controller. When the program of the electric safety controller is restarted e.g. after a power failure, those variables describing the status of the program executed by the electric safety controller the index variable for which has been used to mark the latest status of the program of the electric safety controller are read from the non-volatile memory of the electric safety controller. This method has the advantage that, in addition to allowing the state of operation of the electric safety controller before an interruption of operation to be established from the highest value of the index variable, it also makes it possible to establish the preceding operational states in an order according to the index. This provides an advantage e.g. when the operation of the safety arrangement is to be elucidated afterwards. In a method according to the invention, the switches defining the state of the landing doors are arranged in series as a series circuit and resistors of equal resistance value are fitted in parallel with the switches. In this method, a voltage is fed into the series circuit by the electric safety controller through a series resistor connected to the voltage output of the electric safety controller and the current flowing in the series circuit is measured. According to this method, limit values R1, R2, . . . , Rn are determined for the current flowing in the series circuit in such manner that R1 corresponds to the highest current value and Rn to the lowest current value and that the limit values are so defined that they correspond to the number of switches open.

In a method according to the invention, the measured current is compared to the limit values R1, R2, . . . , Rn, of which limit value R1 is highest. If the current measured exceeds the predetermined limit value R1, then it is inferred that all the landing door switches fitted in the series circuit are closed. If the current measured is within the range of variation of one of the predetermined current limit values R2, . . . , Rn, then the number of switches open is inferred in such manner that the lowest limit value Rn corresponds to the largest number of switches open and when the current value increases the number of switches open decreases. In the method of the invention, the position of the switches defining the state of the landing doors can also be monitored without resistors added in parallel with the switches. In this case, the current flowing through a series resistor connected to the voltage output of the electric safety controller is measured. When one of the landing door switches is opened, the flow of current through the series resistor is interrupted.

In an embodiment of the invention, the voltage output of the electric safety controller need not necessarily be provided with a separate series resistor. In this case, the current of the voltage output is limited by some other method, e.g. by an active current limiting connection formed using transistors.

In another method according to the invention, resistors differing from each other in resistance value are fitted in parallel with the switches defining the state of the landing doors. In this method, a voltage is fed by the electric safety controller into the series circuit through a series resistor connected to the voltage output of the electric safety controller and the current flowing in the series circuit is measured. The measured current is compared to a predetermined current limit value R1, which concerns the highest predetermined current limit value. At the same time the limit value R1 corresponds to a situation where all the switches in the series circuit are closed. In addition, the measured current is compared to predetermined ranges of current variation, each one of said ranges indicating the opening of one or more series circuit switches corresponding to the range of variation in question. By defining beforehand a range of current variation within which the current flowing through the series circuit must remain when a given landing door switch is open, it is possible to ensure that the current value is identifiable even if the resistance value of the resistor fitted in parallel with the switch should vary within the scope of a tolerance or range of variation.

By observing the current flowing in the series circuit, it is also possible to analyze the working condition of the series circuit, e.g. in case of an earth fault in the series circuit. This can be accomplished by measuring the current flowing into the series circuit and the current returning from the series circuit. After this, the current flowing into the series circuit and the current returning from the series circuit are compared to each other. If the values of the current flowing in and the current returning differ from each other by more than a predetermined limit value, then operation of the elevator is prevented by sending by means of the electric safety controller a control command to at least one mechanical stopping device and in the same connection a stopping command is transmitted by the electric safety controller via the data interface bus to the elevator motor controller and data regarding the stopping is sent to the control devices.

Although the above description proposes an apparatus and a method for reading the state of landing door switches by the aid of resistors fitted in parallel with the switches, it is obvious to a person skilled in the art that it is also possible to read the operational state of other switches in an elevator system by using a corresponding apparatus and method. For example, it is possible to use a similar apparatus and method to read the end-limit switches or the switches measuring the car door position.

The mechanical stopping device according to the invention may be e.g. a braking device engaging the elevator traction sheave or a braking device engaging an elevator car guide rail. It is also possible that the safety arrangement of the invention comprises both of the aforesaid braking devices.

In a preferred embodiment of the invention, the electric safety controller comprised in the electric safety system consists of a connection interface and two or more microcontrollers, which are arranged to communicate with each other via a connection bus reserved for that purpose and all of which execute the same program independently from each other, and which microcontrollers are arranged to monitor each other's operational state and to read via the connection interface the detector data and, when necessary, to issue a control command to one or more mechanical stopping devices which prevent movement of the elevator in the elevator shaft. The purpose of this arrangement is to make sure that, when a fault occurs, the electric safety controller will still be able to guarantee the safety of the elevator system.

A safety arrangement according to the invention comprises a controllable manipulator by means of which the mechanical safety device can be set into a working position, said manipulator being controlled by the electric safety controller comprised in the electric safety system. The safety arrangement also comprises means for checking the service condition of the mechanical safety device by operating the controllable manipulator as well as means for checking the service condition of the controllable manipulator. The electric safety controller has been arranged to set the mechanical safety device automatically into the working position by appropriate control of the manipulator when it detects a control situation allowing both manual opening of a landing door and maintenance operation of an elevator maintenance operation unit.

In a preferred embodiment of the invention, at least one detector comprised in the electric safety system is duplicated.

In another preferred embodiment of the invention, the structure of at least one detector comprises a mechanical switch openable by forced control.

In a safety arrangement according to the invention, the detectors fitted in conjunction with the landing doors are bistable switches which are opened and remain open when the landing doors are opened. In connection with the switches, there may further be arranged means for subsequent closing of the switches.

In the electric safety system of the invention, a separate detector for identifying an open landing door may be arranged in conjunction with the elevator landing door on the bottommost floor. In addition, means for separately reading the state of the aforesaid detector via the communication bus may be arranged in conjunction with the electric safety controller.

An arrangement according to the invention comprises means for monitoring the condition of the detectors comprised in the electric safety system. Arranged in conjunction with the electric safety controller are e.g. means for changing the operational state of the detectors and means for measuring a change in the operational state of the detectors.

ADVANTAGES OF THE INVENTION

The elevator safety device of the invention has significant advantages as compared to prior art. The invention makes it possible to identify a 'person in shaft' state via a simple arrangement. It is only necessary to add a single resistor in parallel with each landing door contact.

In the safety arrangement of the invention, as the states of the detectors in the electric safety system are monitored by a separate electric safety controller, the signals to be monitored can be filtered by software in the electric safety controller as necessary. Thus, the system is immune to short-duration breaks in the contacts of the switches. As the number of malfunctions of the elevator system caused by these short-duration breaks is reduced, the reliability and utilization rate of the elevator system are improved.

The safety arrangement of the invention requires a very complex operating logic to ensure that the system will identify all possible failure situations. Based on the measurement results obtained from the detectors, the logic employed is required to exclude all operating states in which maintenance operation is prohibited and to allow those operating states in which maintenance operation is allowed. Moreover, the system is required to be able to infer whether detectors have become defective. In the safety system of the invention, supervision of operation is performed in a centralized manner in the electric safety controller, which simplifies the implementation as compared to a solution implemented using discrete components. At the same time, the total number of components in the system is reduced and the reliability of the system is improved.

The electric safety system of the invention contains separate end limit markers for normal and maintenance operation. The fact that, in the solution of the invention, both the choice as to which end limit switches are to be used in each situation and the deduction regarding the operating state of the safety arrangement are performed in a centralized manner by the electric safety controller ensures that the operating state of the safety arrangement determined by measurements by the detectors of the electric safety system corresponds to the end limit markers being used. When the end limit markers are read by the electric safety controller by means of end limit marker readers, it is possible to make sure that the correct end limit markers are selected in a situation where a serviceman operates the elevator in maintenance mode from the elevator shaft. By fitting the end limit markers and marker readers advantageously in a mutually staggered manner, it will be sufficient to use only two end-limit marker readers. This simplifies the safety arrangement, reduces the wiring and improves the reliability of the system. Using the electric safety controller, it is also possible to permit a direction-dependent read logic in the reading of end-limit markers. If for example As the switches comprised in the elevator safety arrangement are read in the manner proposed in the invention by measuring the current flowing through the resistors fitted in connection with the switches, the state of the series-connected switches can be determined by the electric safety controller via a single current measurement. This simplifies the connection interface between the electric safety controller and the switches to be read. In the safety regulations concerning the elevator industry it is stated that, when metal film resistors are preferably used as components in an electric safety circuit, a short circuit of resistors can be disregarded in the consideration of failures. When a resistor undergoes a failure by being broken, the failure can always be detected by the electric safety controller, and therefore resistors can also be used to measure safety circuits, such as in the case of landing door switches. Resistors are also advantageous as components for use in the measurements in the electric safety system.

According to the invention, the 'person in shaft' state is saved to the non-volatile memory of the electric safety controller and the data regarding the transition into that state is preserved until it is cleared by means of a specific manually operated reset mechanism. In conjunction with the electric safety controller, the reset mechanism may be e.g. a switch lockable with a key, and the state of the switch can be read directly by the same safety controller, thus allowing a simple and advantageous solution to be achieved as compared to a situation where the switch read logic is implemented using discrete components.

In the safety controller of the invention, the detectors in the safety arrangement can be read in a centralized manner. There may be a serial communication bus arranged between them, or they may be connected in series. The amount of wiring needed in the electric safety system is thus reduced.

In the electric safety system of the invention, it is also possible to monitor the operation of different detectors by means of the electric safety controller, and a possible failure can be detected. Furthermore, it is possible to distinguish a failure situation of an individual detector, and corresponding information can be sent directly to a maintenance center, the system diagnostics being thus improved.

As the number of discrete components, such as relays, in the electric safety system is reduced, this also reduces the problems caused by mechanical wear which are inherent with these components and restrict their service life.

DESCRIPTION OF THE DRAWINGS

In the following, the invention will be described in detail by referring to the attached drawings, wherein.

EMBODIMENT EXAMPLES

Figure 1:
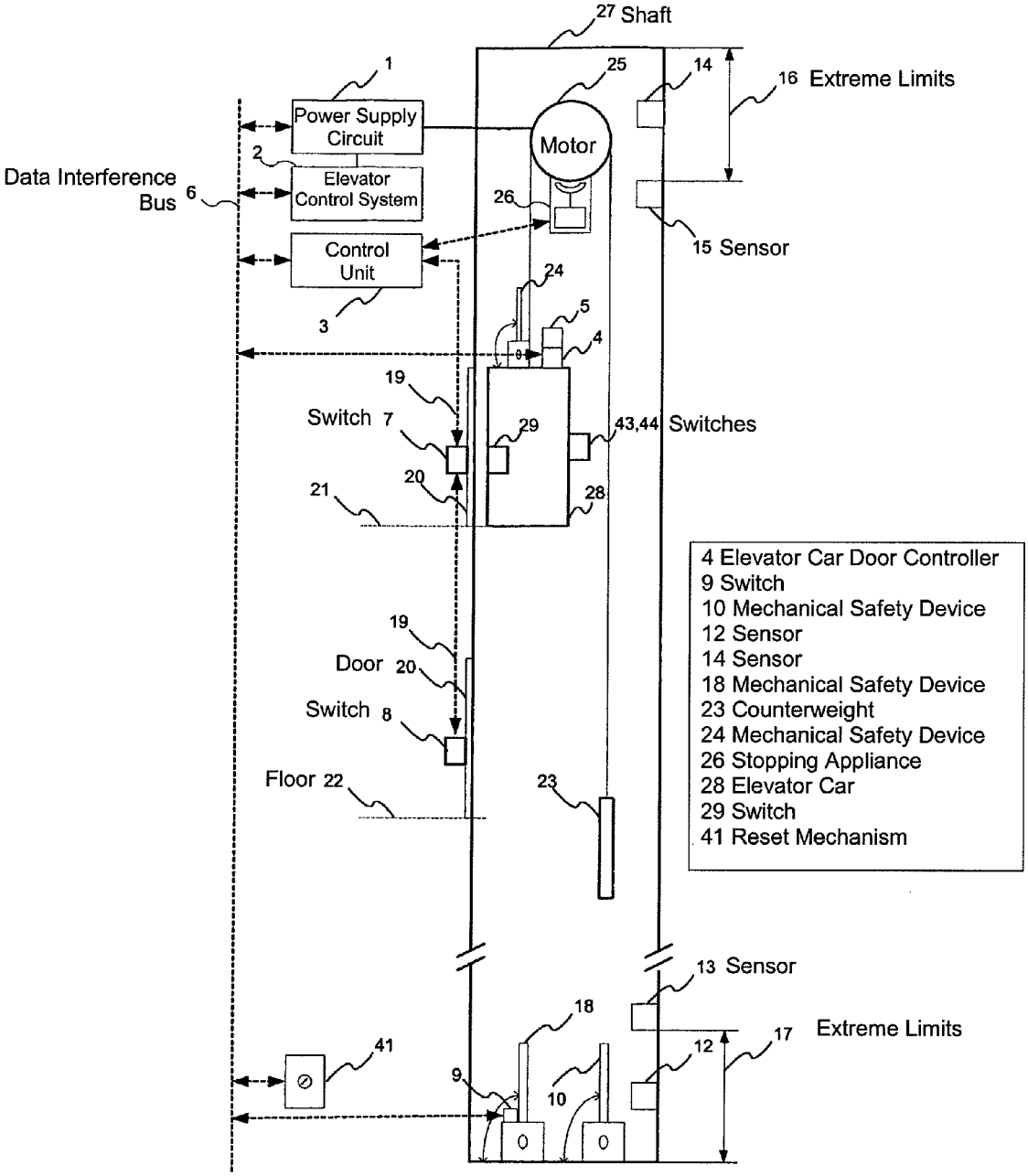
FIG. 1 represents a safety arrangement according to the invention.

FIG. 1 represents an elevator system applying a safety arrangement according to the invention. An elevator car 28 has been fitted to travel in an elevator shaft 27 from floor to floor 21, 22. This elevator system according to the invention also comprises a counterweight 23, but the elevator system of the invention may also be implemented without a counterweight. The elevator motor 25 is disposed in the elevator shaft, but it may also be placed in a machine room.

The extreme limits of movement of the elevator car in the elevator shaft are determined by end limit markers 12, 13, 14, 15. During normal operation, the elevator car travels between the extreme limits determined by end limit markers 12, 14. When the mechanical safety devices 10, 18, 24 have been set into their active position, the elevator can only be operated in maintenance mode within the shaft portion defined by end limit markers 13, 15. Fitted in conjunction with the elevator car are end limit marker readers 43, 44. In this embodiment of the invention, the end limit markers used are ramps and the end limit marker readers are switches that can be brought into contact with the ramps.

Via a gateway 19, the electric safety controller reads switches 7, 8 measuring the position of the landing doors and, via a data interface bus 6, a detector 29 measuring the position of the elevator car. Based on the positions of these, the electric safety controller infers a transition of the safety system into the 'person in shaft' state. In this situation, operation of the elevator both in normal mode and in maintenance mode is inhibited.

When the switch 9 reading the operating state of the mechanical safety device indicates that the mechanical safety device has been reset to the working position, maintenance operation is allowed. The electric safety controller reads the switch indicating the state of the elevator maintenance operation unit via the data interface bus 6 and allows maintenance operation by controlling the brake 26.

The elevator shaft is provided with two different sets of end limits to determine the extreme limits of movement of the elevator car. During normal operation, the elevator is allowed to come closer to the end, determined by the ramps 12, 14. In maintenance operation mode, the extreme limits of movement are defined by ramps 13, 15. The electric safety controller 3 reads the position of the elevator car in the elevator shaft by means of switches 43, 44 and, when the elevator moves past a ramp, stops it by controlling the brake 26. The switch is opened when it comes into contact with a ramp. In this preferred embodiment of the invention, the switches are fitted in a staggered arrangement with the ramps such that switch 43 reads ramps 12 and 15 and switch 44 reads ramps 13 and 14. This is accomplished by disposing the ramps 12 and 15 in the elevator shaft in such a way that that they are located on the path of movement of switch 43 and disposing markers 13 and 14 in such a way that they are located in the path of movement of switch 44 as the elevator car is moving in the elevator shaft.

If it detects that both switch 43 and switch 44 are open, the electric safety controller prevents elevator operation in both normal and maintenance modes. If only switch 43 is open, then upward movement in maintenance operation mode is inhibited. If only switch 44 is open, then downward movement in maintenance operation mode is inhibited.

The electric safety controller 3 additionally communicates via the data interface bus 6 with at least the elevator system controller 2, with the elevator motor controller 1 and the elevator car door controller 4.

The electric safety controller 3 makes an inference about the operating state of the safety arrangement of the elevator. If the controller detects a functional deviation on the basis of the data it has read from the detectors, it issues a control command to the mechanical stopping device 26. In addition, it sends over the data interface bus 6 a command preventing operation to the elevator motor controller 1 and data indicating the functional deviation to the other control devices 2, 4.

When the electric safety controller 3 detects a 'person in shaft' state, it saves corresponding data to the non-volatile memory of the safety controller. After this, the electric safety controller can only be restored to its normal state by means of a manually operated reset mechanism 41. In the safety arrangement according to FIG. 1, the manually operated reset mechanism is disposed on the lowest floor in the elevator shaft, and the electric safety controller reads the state of the reset mechanism via the data interface bus 6. The manually operated reset mechanism 41 can also be disposed in connection with the electric safety controller, and the electric safety controller can read the state of the reset mechanism 42 via a specific separate communication bus.

In the safety arrangement according to FIG. 1, a mechanical safety device 24 is also placed on the top of the elevator car 28. In this case, the state of the safety device can be read by the electric safety controller 3 via the data interface bus 6.

Figure 2:
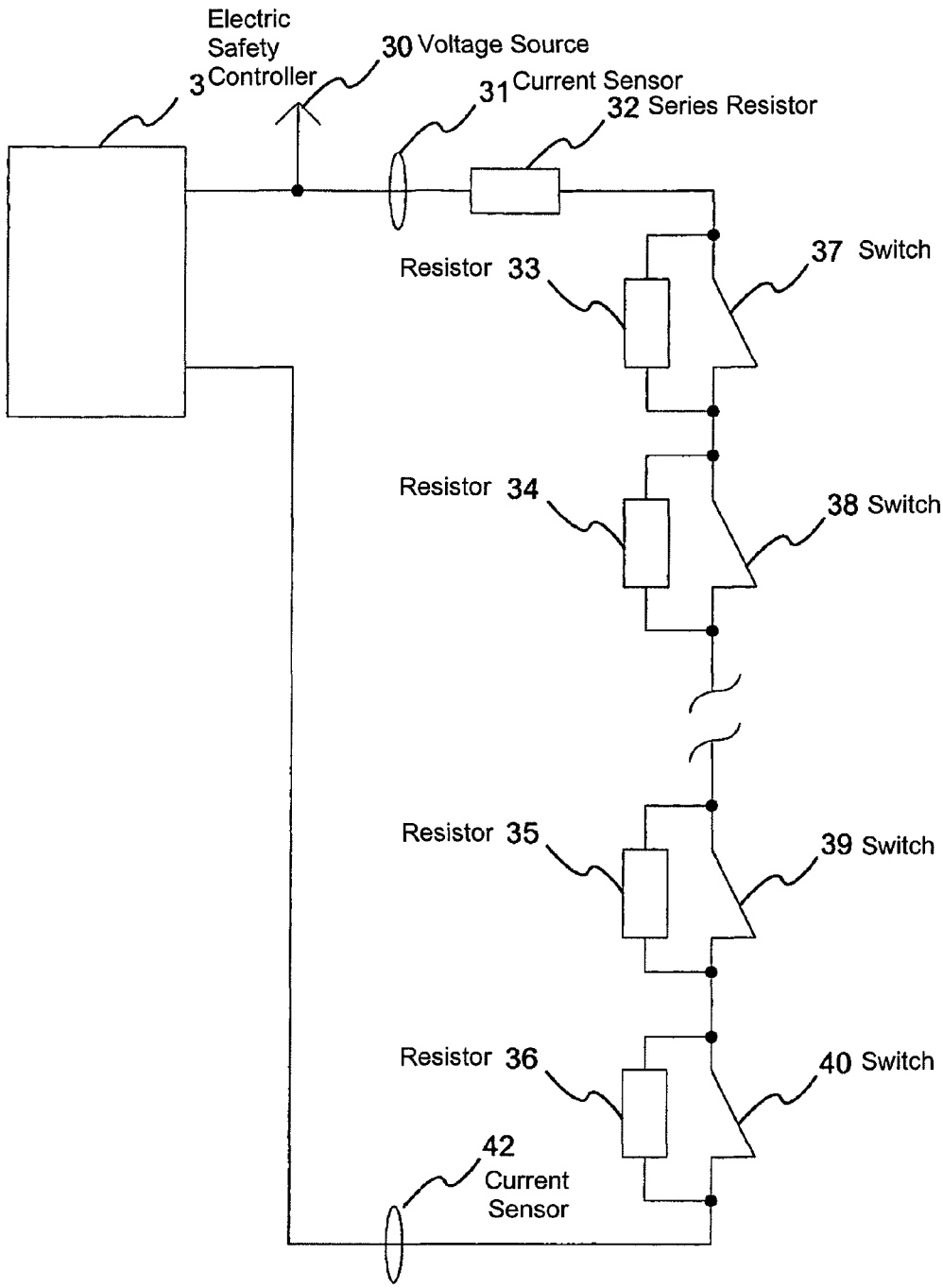
FIG. 2 represents a set of equipment used in an embodiment of the invention for identifying the state of the switches

FIG. 2 represents a set of equipment according to the invention which can be used to read the operating states of the switches 37, 38, 39, 40 in the electric safety system. These switches are connected as a series circuit and resistors 33, 34, 35, 36 are fitted in parallel with them. The series circuit is connected to the electric safety controller 3. The electric safety controller feeds a voltage 30 into the series circuit through a series resistor 32. The equipment additionally comprises means for measuring 31, 42 the current flowing in the series circuit.

The electric safety controller feeds a known voltage 30 into the series circuit through the series resistor 32. When the switches 37, 38, 39, 40 are closed, the current flowing in the series circuit is only limited by resistor 32. The current can now be measured by the measuring devices 31, 42 and the state of the series circuit can be read correspondingly. When one of the switches is opened, the current path through that switch is interrupted and the current starts flowing through the resistor fitted in parallel with the switch. For example, when switch 37 is opened, the current starts flowing through resistor 33. At the same time, the current flowing in the series circuit is reduced, because the flow of the current is limited by the series connection of resistors 32 and 33. If additionally switch 38 is opened, then the current is reduced further, because its flow is limited by the series connection of resistors 32, 33 and 34. When the current flowing in the series circuit is measured by the measuring devices 31, 42, a change in the current can be detected while at the same time detecting a change in the state of the switches in the series circuit corresponding to the current change.

As the resistor connected in parallel with each switch 37, 38, 39, 40 is of the same resistance value, the current measurement can reveal the opening of one or more switches. The current flowing in the series circuit is the smaller the more switches are open. In this case, however, it is not possible to identify which particular switch is open. If instead the resistors 33,34,35,36 in the series circuit are so chosen that they differ from each other in resistance value, then it is possible to identify the state of each individual switch in the series circuit. In this case, in choosing the resistors it is also necessary to consider combinations of different resistors so that the value of each single resistor should differ from the combination of a series connection of two or more different resistors to allow the state of an individual switch to be detected.

Using a set of equipment as illustrated in FIG. 2, it is also possible to identify a failure of the series circuit of the switches, e.g. an earth fault. In this case, the current flowing into the series circuit is measured by measuring device 31 and the current returning from the series circuit to the electric safety controller by measuring device 42. In the case of an earth fault, some of the current fed into the series circuit escapes at the point of earth fault to other structural parts while only a proportion of it returns back to the electric safety controller 3 via the series circuit. The returning current is measured by measuring device 42, and the fault condition can be detected by comparing the current flowing out of the series circuit and the current returning into the series circuit.

Figure 3:
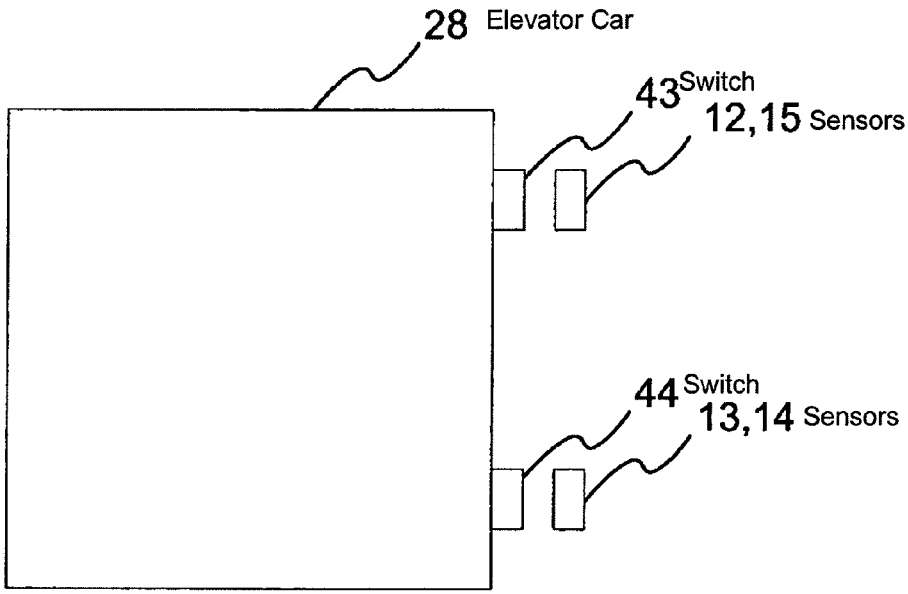
FIG. 3 represents an elevator car according to FIG. 1 as seen from above.

FIG. 3 is a top view representation of an elevator car 28 according to FIG. 1. As shown in the figure, the switches 43 and 44 are placed in a staggered arrangement with the ramps 12,13,14,15 in such manner that ramps 12 and 15 lie in the path of switch 43 and ramps 13 and 14 lie in the path of switch 44 as the elevator car 28 is moving in the elevator shaft. Thus, switch 43 can be used to read the ramp 15 in the upper part of the elevator shaft which determines the extreme limit of movement during maintenance operation and the ramp 12 in the lower part of the elevator shaft which determines the extreme limit of movement during normal operation. Switch 44 can similarly be used to read the ramp 14 in the upper part of the elevator shaft which determines the extreme limit of movement during normal operation and the ramp 13 in the lower part of the elevator shaft which determines the extreme limit of movement during maintenance operation.

The invention has been described above with reference to a few embodiment examples. It is obvious to the person skilled in the art that the invention is not limited to the embodiments described above, in which the invention has been described by way of example, but that many variations and different other embodiments of the invention are possible within the scope of the inventive concept defined in the claims presented below.

The invention claimed is:

1. A safety arrangement for implementing safety spaces in an elevator shaft, said safety arrangement comprising:

a mechanical safety which can be moved to a working position to ensure a sufficient safety space in the elevator shaft, and an electric safety system comprising:

at least one first detector for identifying the operating state of the mechanical safety device, and at least one second detector for identifying the position of a landing door, means for reading the at least one second detector;

at least one third detector for identifying the position of an elevator car door, and means for reading the at least one third detector;

an electric safety controller, which reads data from the detectors, and based on the data obtained, controls a mechanical stopping device which prevent movement of the elevator car in the elevator shaft;

elevator control devices;

a data interface bus between the electric safety controller and the elevator control devices wherein the safety arrangement comprises two separate sets of end limit markers for determining the position of the elevator car, a first set located closer to the ends of the elevator shaft determine the extreme limits of elevator car movement during normal operation while a second set located farther away from the ends of the elevator shaft than the first set determine the extreme limits of elevator car movement during maintenance operation, and readers of the end limit markers are fitted with the elevator car, said readers being connected to the electric safety controller via the data interface bus.

2. The safety arrangement according to claim 1, wherein the safety arrangement further comprises:

at least one fourth detector for identifying the state of control of the elevator maintenance operation unit, and at least one end limit marker, and at least one end limit marker reader for determining the extreme limits of elevator car movement in the elevator shaft.

3. The safety arrangement according to claim 1, wherein the elevator control devices are an elevator system controller, an elevator motor controller and an elevator car door controller.

4. The safety arrangement according to claim 1, wherein the at least one second detector is a switch whose contact is opened by forced control as the landing doors are opened, and arranged in series as a series circuit, which is connected to the electric safety controller via a gateway to allow measurement of the state of the series circuit.

5. The safety arrangement according to claim 4, wherein the means for reading the at least one second detector comprise a resistor of equal resistance value fitted in parallel with each switch in the series circuit.

6. The safety arrangement according to claim 4, wherein the means for reading the at least one second detector comprise a resistor of different resistance value fitted in parallel with each switch in the series circuit for identification of the position of each individual switch.

7. The safety arrangement according to claim 5, wherein the resistor is an encapsulated film resistor.

8. The safety arrangement according to claim 4, wherein the electric safety controller comprises means for measuring the total resistance of the series circuit.

9. The safety arrangement according to claim 1, wherein the electric safety controller is integrated with another control device of the elevator system.

10. The safety arrangement according to claim 2, wherein one of the elevator control devices is an elevator system controller, an elevator motor controller and an elevator car door controller.

11. The safety arrangement according to claim 2, wherein the at least one second detector is a switch whose contact is opened by forced control as the landing doors are opened, and switches are arranged in series as a series circuit, which is connected to the electric safety controller via a gateway to allow measurement of the state of the series circuit.

12. The safety arrangement according to claim 3, wherein the at least one second detector is a switch whose contact is opened by forced control as the landing doors are opened, and switches are arranged in series as a series circuit, which is connected to the electric safety controller via a gateway to allow measurement of the state of the series circuit.

13. The safety arrangement according to claim 6, wherein the resistor is preferably an encapsulated film resistor.

14. The safety arrangement according to claim 1, wherein the mechanical safety device is at a bottom of the elevator shaft.

15. The safety arrangement according to claim 1, wherein the mechanical safety device is on top of the elevator car.

* * * * *